US011710491B2

(12) United States Patent
Tian et al.

(10) Patent No.: US 11,710,491 B2
(45) Date of Patent: Jul. 25, 2023

(54) METHOD AND APPARATUS FOR SPACE OF INTEREST OF AUDIO SCENE

(71) Applicant: TENCENT AMERICA LLC, Palo Alto, CA (US)

(72) Inventors: Jun Tian, Belle Mead, NJ (US); Xiaozhong Xu, State College, PA (US); Shan Liu, San Jose, CA (US)

(73) Assignee: TENCENT AMERICA LLC, Palo Alto, CA (US)

( * ) Notice: Subject to any disclaimer, the term of this patent is extended or adjusted under 35 U.S.C. 154(b) by 0 days.

(21) Appl. No.: 17/499,398

(22) Filed: Oct. 12, 2021

(65) Prior Publication Data

US 2022/0335955 A1 Oct. 20, 2022

Related U.S. Application Data

(60) Provisional application No. 63/177,258, filed on Apr. 20, 2021.

(51) Int. Cl.

| | |
|---|---|
| ***G10L 19/008*** | (2013.01) |
| ***G10L 19/002*** | (2013.01) |
| ***H04S 7/00*** | (2006.01) |
| ***H04S 3/00*** | (2006.01) |

(52) U.S. Cl.

CPC ..... *G10L 19/008* (2013.01); *G10L 19/002* (2013.01); *H04S 3/008* (2013.01); *H04S 7/30* (2013.01); *H04S 2400/01* (2013.01)

(58) Field of Classification Search

CPC ..... G10L 19/167; G10L 19/24; H04S 7/30
USPC ..... 381/310, 22, 23
See application file for complete search history.

(56) References Cited

U.S. PATENT DOCUMENTS

| | | | | |
|---|---|---|---|---|
| 2014/0358567 | A1* | 12/2014 | Koppens | H04S 7/308 704/500 |
| 2015/0156578 | A1 | 6/2015 | Alexandridis et al. | |
| 2016/0104491 | A1 | 4/2016 | Lee et al. | |
| 2017/0249945 | A1 | 8/2017 | Koppens et al. | |
| 2018/0190300 | A1* | 7/2018 | Mate | H04S 7/304 |
| 2018/0225885 | A1* | 8/2018 | Dishno | H04L 67/02 |
| 2022/0270509 | A1* | 8/2022 | Josephson | G06F 3/0346 |

OTHER PUBLICATIONS

"Multichannel stereophonic sound system with and without accompanying picture", International Telecommunication Union, ITU-R Radiocommunication Sector of ITU, BS Series, Broadcasting Service (Sound), Recommendation ITU-R BS.775-3, Aug. 2012, pp. 1-23.

International Search Report and Written Opinion dated Jan. 18, 2022 in International Patent Application No. 21/54946, 15 pages.

* cited by examiner

*Primary Examiner* — Alexander Krzystan
(74) *Attorney, Agent, or Firm* — ArentFox Schiff LLP

(57) ABSTRACT

Aspects of the disclosure include methods, apparatuses, and non-transitory computer-readable storage mediums for decoding audio data of an audio scene. One apparatus includes processing circuitry that receives first audio source data and second audio source data. The first audio source data corresponds to a space of interest in the audio scene and the second audio source data does not correspond to the space of interest in the audio scene. The space of interest in the audio scene is represented by at least one of a listener space, an audio channel, or an audio object. The processing circuitry decodes the first audio source data based on the space of interest.

20 Claims, 7 Drawing Sheets

METHOD AND APPARATUS FOR SPACE OF INTEREST OF AUDIO SCENE

INCORPORATION BY REFERENCE

The present application claims the benefit of priority to U.S. Provisional Application No. 63/177,258, "SPACE OF INTEREST OF AUDIO SCENE," filed on Apr. 20, 2021, which is incorporated by reference herein in its entirety.

TECHNICAL FIELD

The present disclosure describes embodiments generally related to audio scene representation.

BACKGROUND

The background description provided herein is for the purpose of generally presenting the context of the disclosure. Work of the presently named inventors, to the extent the work is described in this background section, as well as aspects of the description that may not otherwise qualify as prior art at the time of filing, are neither expressly nor impliedly admitted as prior art against the present disclosure.

A region of interest (ROI) is a region of samples within a data set identified for a particular purpose. The concept of an ROI is commonly used in many application areas such as medical imaging, geographical information systems, computer vision, optical character recognition, and the like.

While a ROI can be used on a one dimensional audio signal, in an audio scene such a concept may not be directly applied. In this disclosure, methods of representing a space of interest of an audio scene are provided.

SUMMARY

Aspects of the disclosure provide apparatuses for decoding audio data of an audio scene. One apparatus includes processing circuitry that receives first audio source data and second audio source data. The first audio source data corresponds to a space of interest in the audio scene and the second audio source data does not correspond to the space of interest in the audio scene. The space of interest in the audio scene is represented by at least one of a listener space, an audio channel, or an audio object. The processing circuitry decodes the first audio source data based on the space of interest.

In an embodiment, the processing circuitry determines that the second audio source data is not to be decoded based on the second audio source data being determined not to correspond to the space of interest.

In an embodiment, the processing circuitry decodes the first audio source data based on a first decoding scheme. The processing circuitry decodes the second audio source data based on a second decoding scheme that is different from the first decoding scheme.

In an embodiment, encoding schemes used in encoding the first audio source data and the second audio source data are different.

In an embodiment, bit allocation schemes used in encoding the first audio source data and the second audio source data are different.

In an embodiment, the processing circuitry renders audio content of the first audio source data based on a first audio rendering scheme. The processing circuitry renders audio content of the second audio source data based on a second audio rendering scheme that is different from the first audio rendering scheme.

In an embodiment, the processing circuitry determines that audio content of the first audio source data is to be rendered and audio content of the second audio source data is not to be rendered based on the second audio source data being determined to not correspond to the space of interest.

In an embodiment, complexities of the first decoding scheme and the second decoding scheme are different.

Aspects of the disclosure provide methods for decoding audio data of an audio scene. In one method, first audio source data and second audio source data are received. The first audio source data corresponds to a space of interest in the audio scene and the second audio source data does not correspond to the space of interest in the audio scene. The space of interest in the audio scene is represented by at least one of a listener space, an audio channel, or an audio object. The first audio source data is decoded based on the space of interest.

Aspects of the disclosure provide apparatuses for encoding audio data of an audio scene. One apparatus includes processing circuitry that receives audio content of a plurality of audio sources in the audio scene. The processing circuitry determines, for each of the plurality of audio sources, whether the respective audio source is in a space of interest in the audio scene. The space of interest in the audio scene is represented by at least one of a listener space, an audio channel, or an audio object. The processing circuitry determines that the audio content of the respective audio source is to be encoded according to a first encoding scheme based on the respective audio source being in the space of interest in the audio scene. The processing circuitry determines that the audio content of the respective audio source is one of (i) not to be encoded or (ii) to be encoded according to a second encoding scheme based on the respective audio source not being in the space of interest in the audio scene. The second encoding scheme is different from the first encoding scheme.

In an embodiment, the audio content of the respective audio source is not to be encoded based on the respective audio source not being in the space of interest in the audio scene.

In an embodiment, the audio content of the respective audio source is to be encoded according to the second encoding scheme based on the respective audio source not being in the space of interest in the audio scene.

In an embodiment, the first encoding scheme is a first bit allocation scheme and the second encoding scheme is a second bit allocation scheme that is different from the first bit allocation scheme.

Aspects of the disclosure provide methods for encoding audio data of an audio scene. In one method, audio content of a plurality of audio sources in the audio scene is received. For each of the plurality of audio sources, whether the respective audio source is in a space of interest in the audio scene is determined. The space of interest in the audio scene is represented by at least one of a listener space, an audio channel, or an audio object. The audio content of the respective audio source is determined to be encoded according to a first encoding scheme based on the respective audio source being in the space of interest in the audio scene. The audio content of the respective audio source is determined one of (i) not to be encoded or (ii) to be encoded according to a second encoding scheme based on the respective audio source not being in the space of interest in the audio scene. The second encoding scheme is different from the first encoding scheme.

Aspects of the disclosure also provide non-transitory computer-readable mediums storing instructions which when executed by at least one processor cause the at least one processor to perform any one or a combination of the methods for encoding/decoding audio data of an audio scene.

BRIEF DESCRIPTION OF THE DRAWINGS

Further features, the nature, and various advantages of the disclosed subject matter will be more apparent from the following detailed description and the accompanying drawings in which.

DETAILED DESCRIPTION OF EMBODIMENTS

I. Representation of Space of Interest

This disclosure includes methods of audio scene description. A space of interest in an audio scene is described in this disclosure. The space of interest can be defined as a border (or an outline or a shape) of a space under consideration in the audio scene. The space of interest can be utilized in audio coding, processing, rendering, and the like.

It is noted that methods included in this disclosure can be used separately or in combination. The methods can be used in part or as a whole.

An audio scene can be a semantically consistent sound segment that is characterized by one or more dominant sources of sound. The audio scene can be modeled as a collection of sound sources. In some embodiments, the audio scene can be dominated by a subset of the collection of sound sources. The subset of the collection of sound sources can be considered as the sound sources in the space of interest.

In some embodiments, the subset of the collection of sound sources representing the audio scene can be determined based on positions of the sound sources in the audio scene. That is, the space of interest can be determined based on the positions of the sound sources in the audio scene.

In one embodiment, the space of interest can be represented by a space where a listener can move to. For example, an entire space can be divided into one or more regions that the listener can move to and other regions that the listener cannot move to. The space of interest can therefore be represented by a collection of the regions that the listener can move to. The sound sources in the regions that the listener can move to can be considered as the sound sources in the space of interest to represent the audio scene, while the sound sources in the regions that the listener cannot move to can be considered as the sound sources outside the space of interest and may not represent the audio scene.

In one embodiment, the space of interest can be represented by a sweet spot(s) of the audio scene, where an individual (e.g., the listener) can be fully capable of hearing an audio mix generated by an audio mixer in a way that it is intended to be heard. In a case of surround sounds, the sweet spot is a focal point among multiple speakers so that all wave fronts arrive simultaneously.

Figure 1:
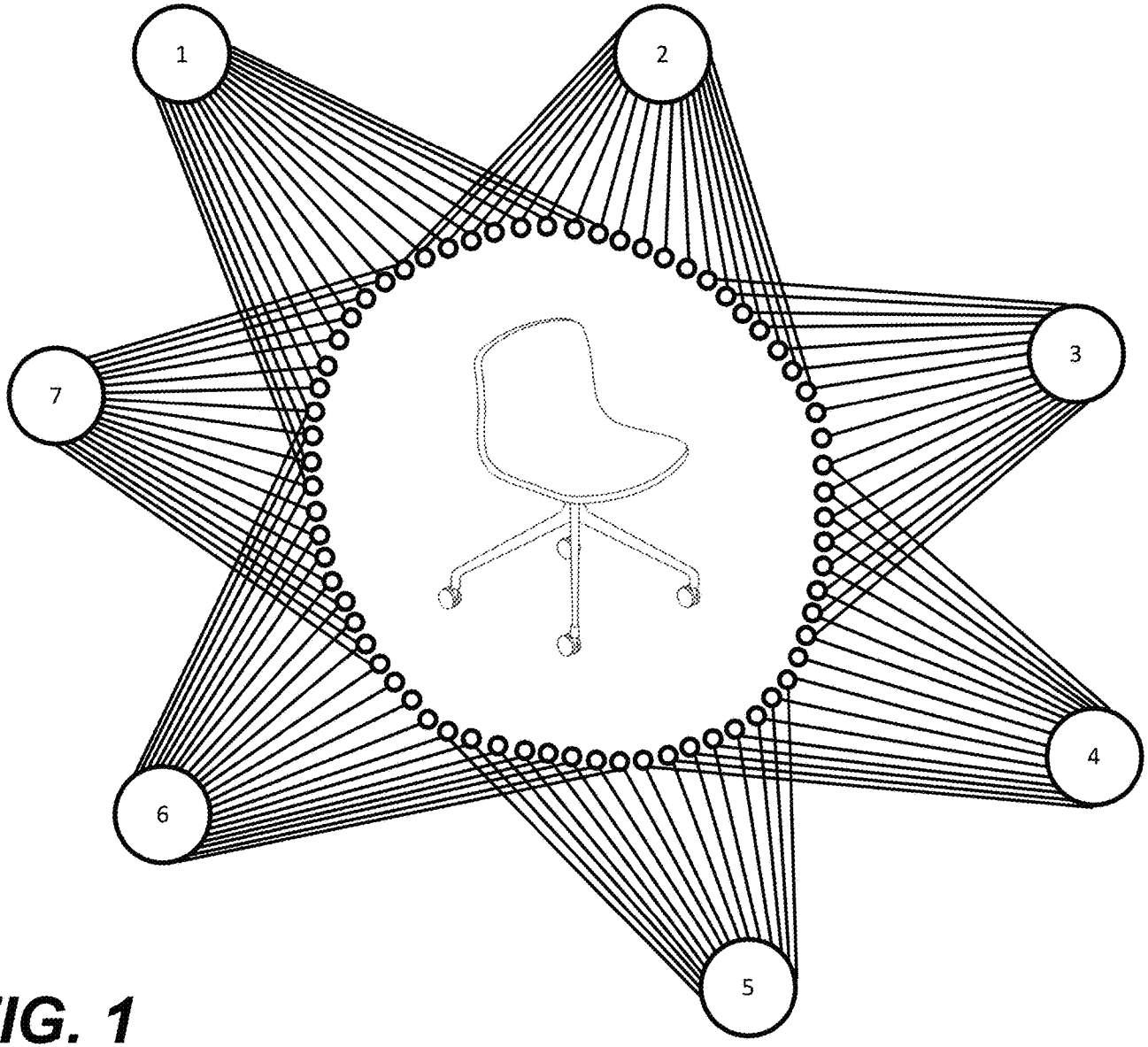
FIG. 1 shows exemplary sweet spots of an audio scene according to an embodiment of the disclosure.

FIG. 1 shows exemplary sweet spots of an audio scene according to an embodiment of the disclosure. In FIG. 1, the sweet spots of the audio scene are the intersection of areas covered by audio sources labeled from 1-7. Thus, the sweet spots are indicated by a circle around a chair in FIG. 1. In some cases such as in international recommendations, the sweet spot can be referred to as a reference listening point.

In some embodiment, the space of interest can be represented by an auditory space.

In one embodiment, the space of interest can be represented by the auditory space with a limited range of elevation. For example, the space of interest can be represented by two numbers, where the auditory space is within the elevation between these two numbers.

Figure 2:
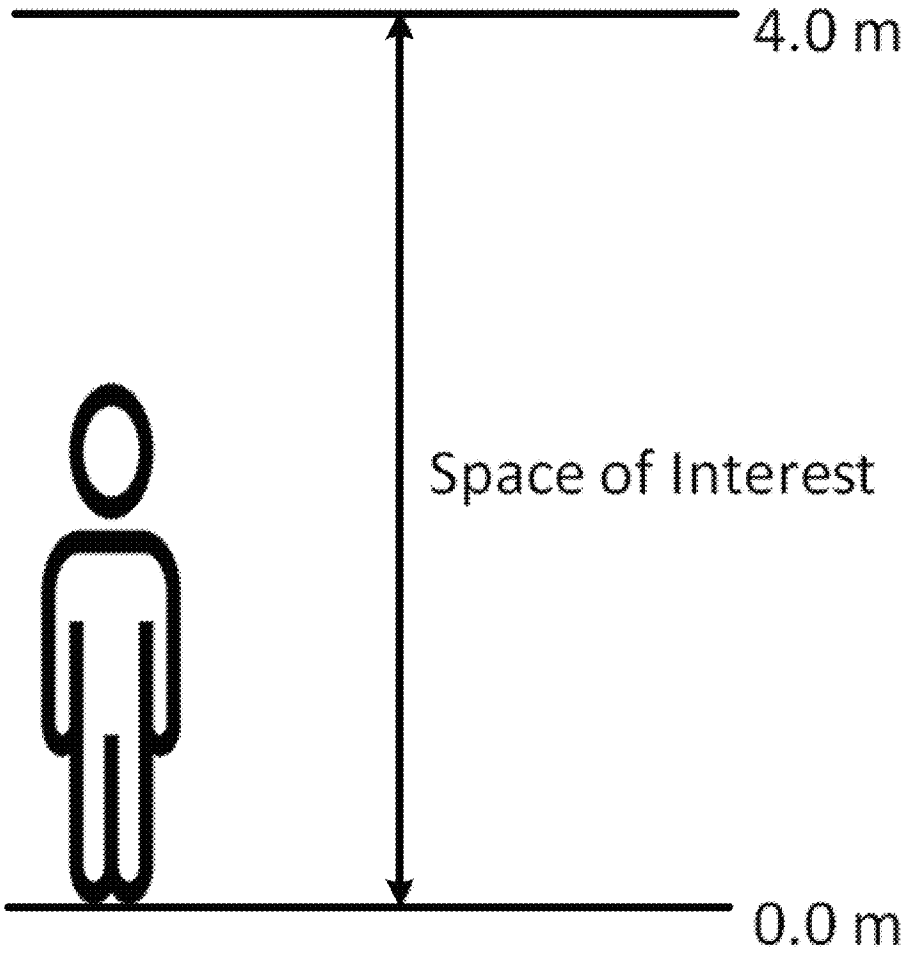
FIG. 2 shows an example of an auditory space with a limited range of elevation according to an embodiment of the disclosure.

FIG. 2 shows an example of an auditory space with the elevation between 0.0 meter and 4.0 meter.

In one embodiment, the space of interest can be represented by the auditory space with a rectangular prism. The representation can be coordinates of two diagonal vertices of the rectangular prism. The representation can be the coordinates of one vertex of the rectangular prism, and values of height, width, and length of the rectangular prism. In some cases, the rectangular prism may not be always vertical or horizontal, so directionality information of the rectangular prism can be described.

In one embodiment, the space of interest can be represented by the auditory space with a polyhedron shape. The representation can be coordinates of vertices of the polyhedron shape. The representation can be a collection of surfaces of the polyhedron shape.

Figure 3:
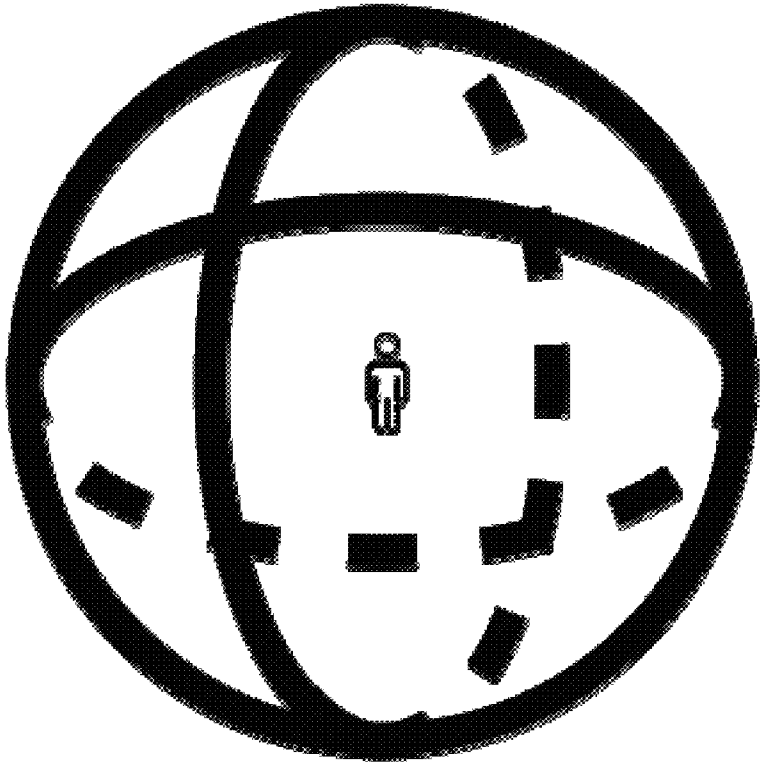
FIG. 3 shows an example of an auditory space with a ball shape according to an embodiment of the disclosure.

In one embodiment, the space of interest can be represented by the auditory space with a ball shape centered at a listener's location, as shown in FIG. 3. The representation can be coordinates of the center of the ball shape, and a value of a radius of the ball shape.

Figure 4:
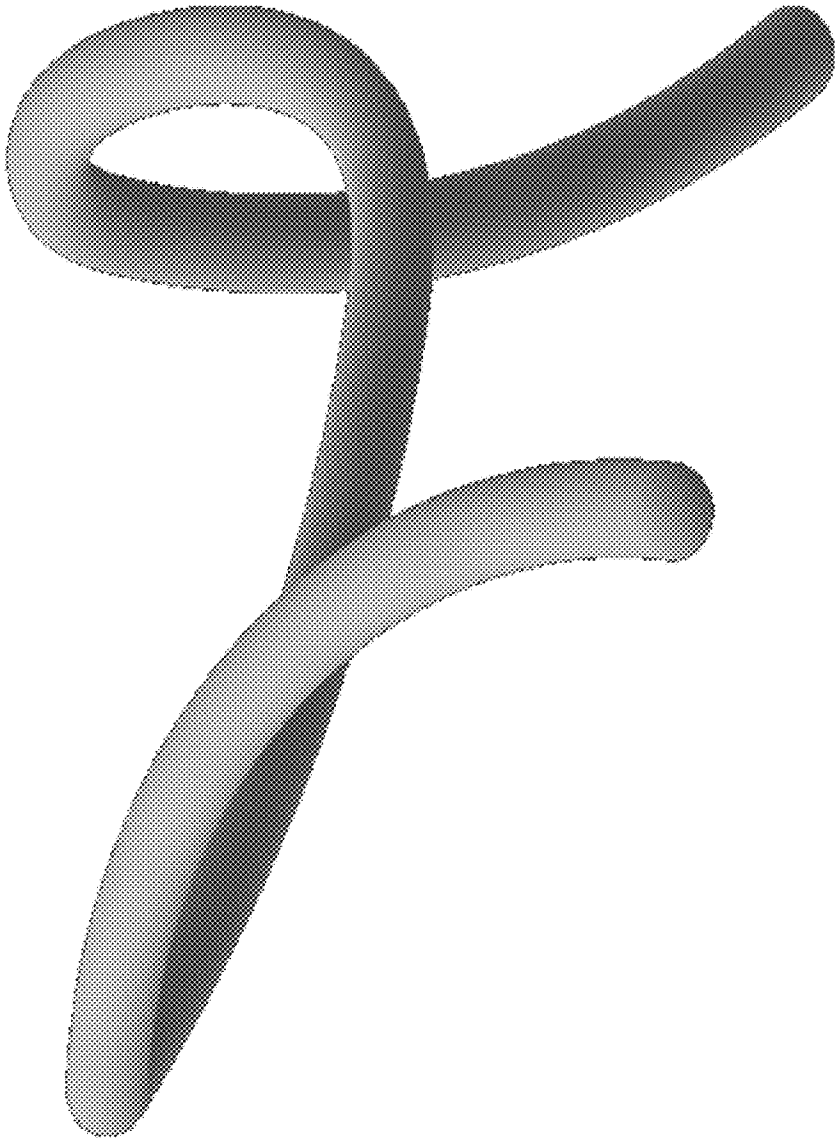
FIG. 4 shows an example of an auditory space with a rolling ball shape according to an embodiment of the disclosure.

In one embodiment, the space of interest can be represented by the auditory space with a rolling ball shape. The center of the rolling ball shape can be along a walking path of a listener, as shown in FIG. 4. The representation can be a function describing the walking path, and the radius of the rolling ball shape.

In one embodiment, the space of interest can be represented by a combination of audio channels out of a multichannel audio. For example, the representation can be a set of the front-left and front-right channels out of a 7.1 audio channel.

In one embodiment, the space of interest can be represented by a combination of audio objects. For example, a hospital audio scene can include audio objects of door, table, chair, TV, radio, doctor, and patient. That is, the hospital audio scene can include various audio sources such as the sounds of or from a door, table, chair, TV, radio, doctor, and patient. The space of interest in this example can be represented by a set of the door, doctor, and patient.

According to aspects of the disclosure, the space of interest can be represented by a collection of two or three types of items from the space where the listener can move to (which is referred to as a listener space), the audio channel, and the audio object. That is, the space of interest of the audio scene can be represented by a collection of listener spaces, audio channels, and/or audio objects.

According to some embodiments of the disclosure, audio content can be encoded based on the space of interest. For example, an audio encoder can apply different encoding strategies to audio content of one or more audio sources in the space of interest and audio content of one or more audio sources outside the space of interest.

In one embodiment, for the audio content of the audio source in the space of interest, the encoder can apply a first bit allocation scheme different from a second bit allocation scheme used for the audio content of the audio source outside the space of interest. For example, a number of bits allocated to the audio content of the audio source in the space of interest is greater than a number of bits allocated to the audio content of the audio source outside the space of interest.

In one embodiment, the encoder can encode only the audio content of the audio source in the space of interest, and discard the audio content of the audio source outside the space of interest.

According to some embodiments of the disclosure, audio content can be decoded based on the space of interest. For example, an audio decoder can apply different decoding strategies to encoded audio content (e.g., a bitstream) of the audio source in the space of interest and encoded audio content of the audio source outside the space of interest.

In one embodiment, the audio decoder can apply one audio decoding scheme on the encoded audio content of the audio source in the space of interest, and another audio decoding scheme on the encoded audio content of the audio source outside the space of interest. In an example, the complexities of the two audio decoding schemes can be different. The complexity of the audio decoding scheme that is applied on the encoded audio content of the audio source in the space of interest is higher than the complexity of the audio decoding scheme that is applied on the encoded audio content of the audio source outside the space of interest. The decoding complexity herein can refer to a number of central processing unit (CPU) instructions consumed by a processor to decode an encoded bitstream.

In one embodiment, the audio decoder can decode only the encoded audio content of the audio source in the space of interest. The encoded audio content of the audio source outside the space of interest can be discarded.

According to some embodiments of the disclosure, audio rendering can be performed based on the space of interest. For example, an audio renderer can apply different audio rendering schemes to decoded audio content of the audio source in the space of interest and decoded audio content of the audio source outside the space of interest.

In one embodiment, the audio renderer can apply one audio rendering scheme on the decoded audio content of the audio source in the space of interest, and another audio rendering scheme on the decoded audio content of the audio source outside the space of interest. In an example, the rendering qualities of the two audio rendering schemes can be different. For example, a complexity of the audio rendering scheme that is applied on the decoded audio content of the audio source in the space of interest is higher than a complexity of the audio rendering scheme that is applied on the decoded audio content of the audio source outside the space of interest, so that the rendering quality of the decoded audio content of the audio source in the space of interest is better than the rendering quality of the decoded audio content of the audio source outside the space of interest.

In one embodiment, the audio renderer can render only the decoded audio content of the audio source in the space of interest, and discard the decoded audio content of the audio source outside the space of interest.

II. Flowchart

Figure 5:
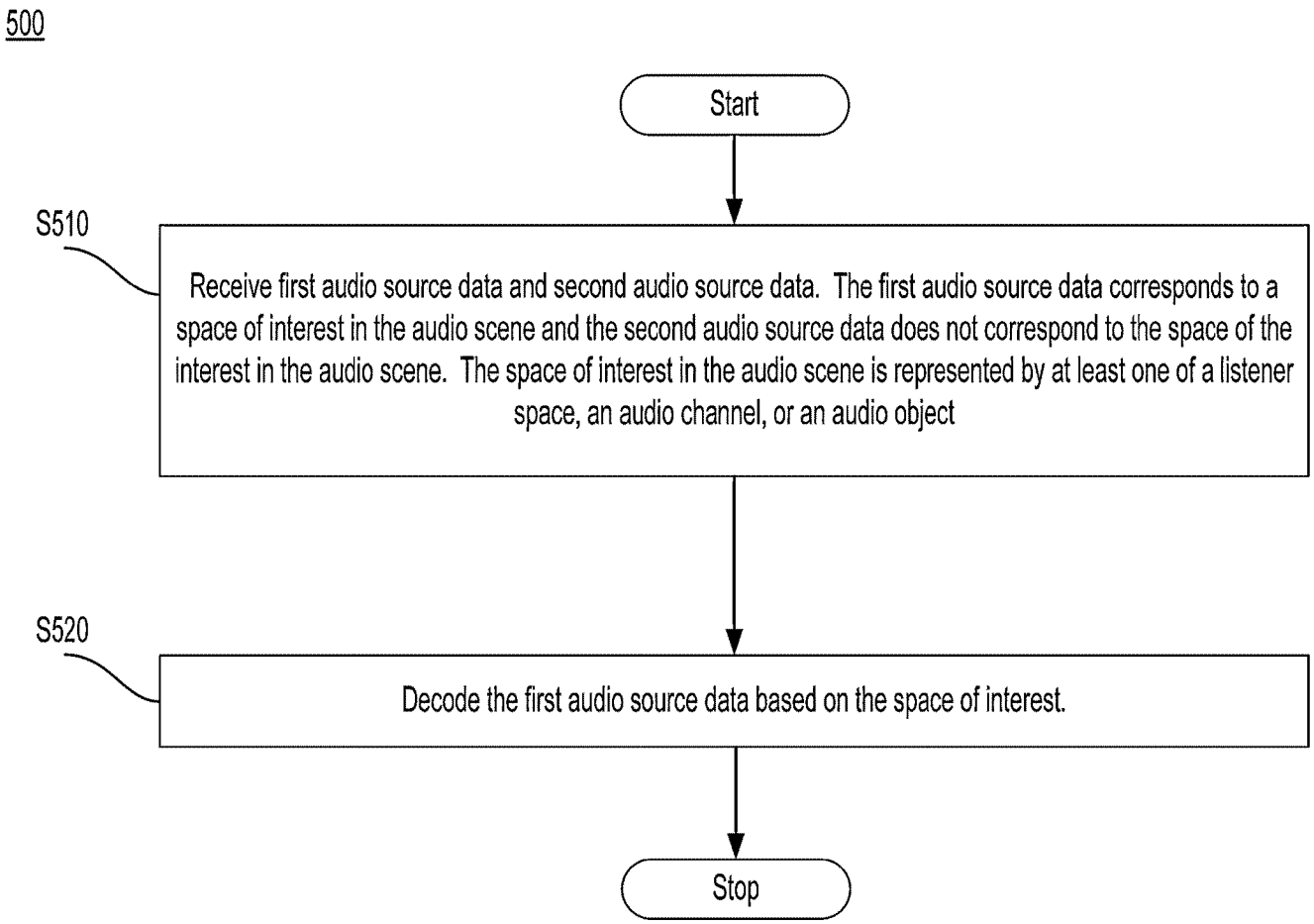
FIG. 5 shows an exemplary flowchart according to an embodiment of the disclosure.
Figure 7:
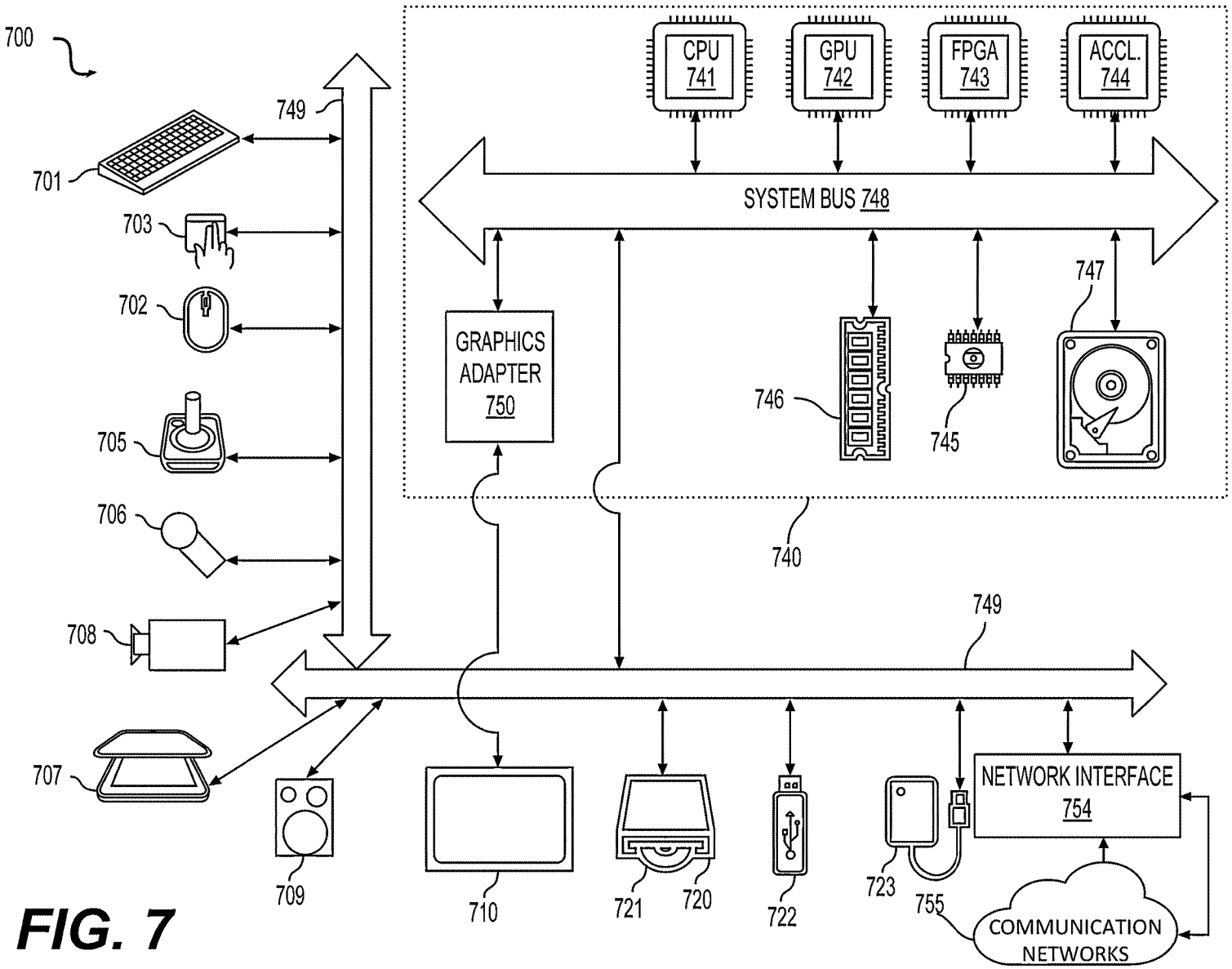
FIG. 7 is a schematic illustration of a computer system according to an embodiment of the disclosure.

FIG. 5 shows a flow chart outlining an exemplary process (500) according to an embodiment of the disclosure. In various embodiments, the process (500) is executed by processing circuitry, such as the processing circuitry as shown in FIG. 7. In some embodiments, the process (500) is implemented in software instructions, thus when the processing circuitry executes the software instructions, the processing circuitry performs the process (500).

The process (500) may generally start at step (S510), where the process (500) receives first audio source data and second audio source data. The first audio source data corresponds to a space of interest in the audio scene and the second audio source data does not correspond to the space of interest in the audio scene. The space of interest in the audio scene is represented by at least one of a listener space, an audio channel, or an audio object. Then, the process (500) proceeds to step (S520).

At step (S520), the process (500) decodes the first audio source data based on the space of interest. Then, the process (500) terminates.

In an embodiment, the process (500) determines that the second audio source data is not to be decoded based on the second audio source data being determined not to correspond to the space of interest.

In an embodiment, the process (500) decodes the first audio source data based on a first decoding scheme. The process (500) decodes the second audio source data based on a second decoding scheme that is different from the first decoding scheme.

In an embodiment, encoding schemes used in encoding the first audio source data and the second audio source data are different.

In an embodiment, bit allocation schemes used in encoding the first audio source data and the second audio source data are different.

In an embodiment, the process (500) renders audio content of the first audio source data based on a first audio rendering scheme. The process (500) renders audio content of the second audio source data based on a second audio rendering scheme that is different from the first audio rendering scheme.

In an embodiment, the process (500) determines that audio content of the first audio source data is to be rendered and audio content of the second audio source data is not to be rendered based on the second audio source data being determined to not correspond to the space of interest.

In an embodiment, complexities of the first decoding scheme and the second decoding scheme are different.

Figure 6:
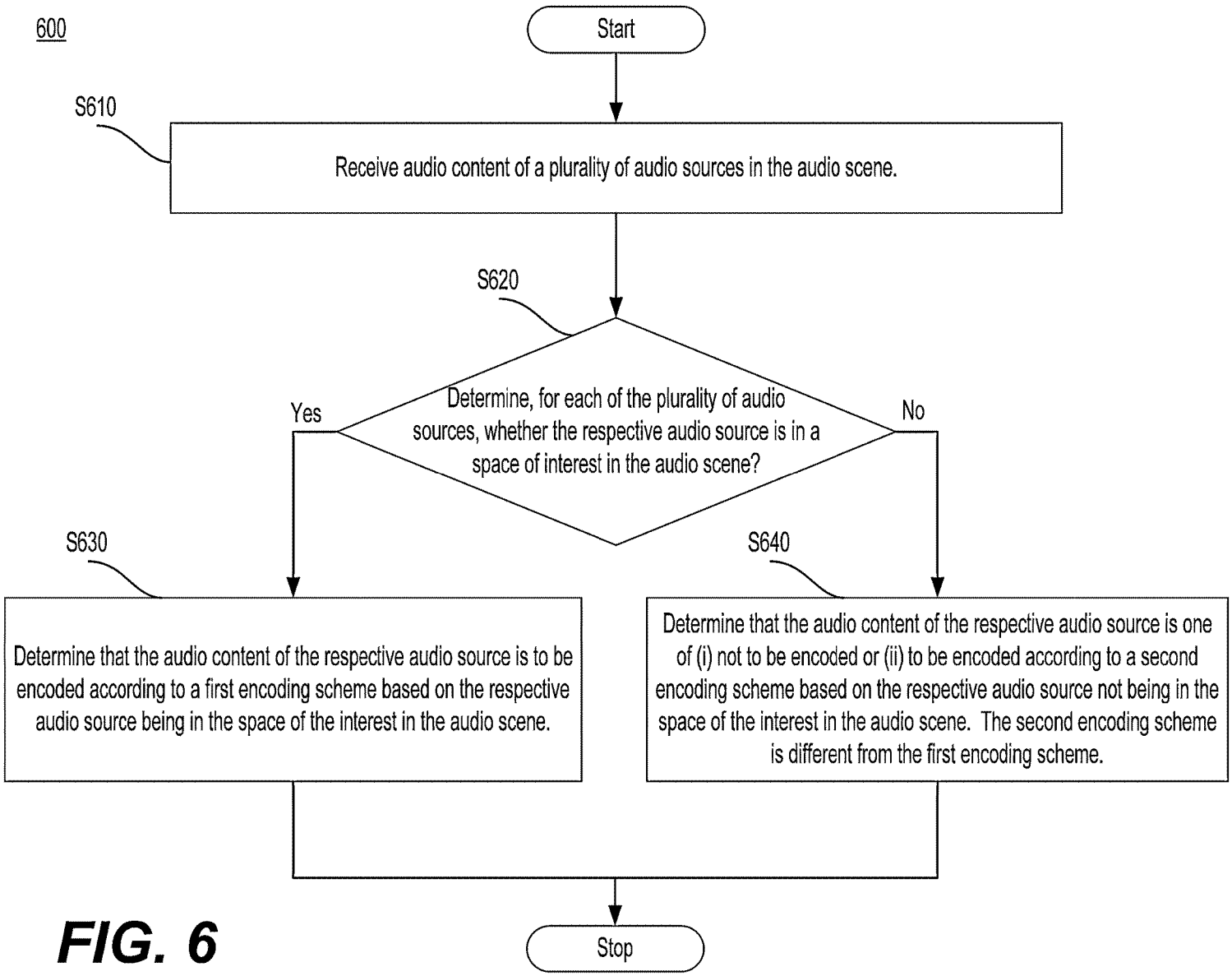
FIG. 6 shows another exemplary flowchart according to an embodiment of the disclosure.

FIG. 6 shows another flow chart outlining an exemplary process (600) according to an embodiment of the disclosure. In various embodiments, the process (600) is executed by processing circuitry, such as the processing circuitry as shown in FIG. 7. In some embodiments, the process (600) is implemented in software instructions, thus when the processing circuitry executes the software instructions, the processing circuitry performs the process (600).

The process (600) may generally start at step (S610), where the process (600) receives audio content of a plurality of audio sources in the audio scene. Then, the process (600) proceeds to step (S620).

At step (S620), the process (600) determines, for each of the plurality of audio sources, whether the respective audio source is in a space of interest in the audio scene. The space of interest in the audio scene is represented by at least one of a listener space, an audio channel, or an audio object. Based on the respective audio source being in the space of interest in the audio scene, the process (600) proceeds to step (S630). Otherwise, the process (600) proceeds to step (S640).

At step (S630), the process (600) determines that the audio content of the respective audio source is to be encoded according to a first encoding scheme based on the respective audio source being in the space of interest in the audio scene. Then, the process (600) proceeds to step (S640).

At step (S640), the process (600) determines that the audio content of the respective audio source is one of (i) not to be encoded or (ii) to be encoded according to a second encoding scheme based on the respective audio source not being in the space of interest in the audio scene. The second encoding scheme is different from the first encoding scheme.

Then, the process (600) terminates.

In an embodiment, the audio content of the respective audio source is not to be encoded based on the respective audio source not being in the space of interest in the audio scene.

In an embodiment, the audio content of the respective audio source is to be encoded according to the second encoding scheme based on the respective audio source not being in the space of interest in the audio scene.

In an embodiment, the first encoding scheme is a first bit allocation scheme and the second encoding scheme is a second bit allocation scheme that is different from the first bit allocation scheme.

III. Computer System

The techniques described above, can be implemented as computer software using computer-readable instructions and physically stored in one or more computer-readable media. For example, FIG. 7 shows a computer system (700) suitable for implementing certain embodiments of the disclosed subject matter.

The computer software can be coded using any suitable machine code or computer language, that may be subject to assembly, compilation, linking, or like mechanisms to create code comprising instructions that can be executed directly, or through interpretation, micro-code execution, and the like, by one or more computer central processing units (CPUs), Graphics Processing Units (GPUs), and the like.

The instructions can be executed on various types of computers or components thereof, including, for example, personal computers, tablet computers, servers, smartphones, gaming devices, internet of things devices, and the like.

The components shown in FIG. 7 for computer system (700) are exemplary in nature and are not intended to suggest any limitation as to the scope of use or functionality of the computer software implementing embodiments of the present disclosure. Neither should the configuration of components be interpreted as having any dependency or requirement relating to any one or combination of components illustrated in the exemplary embodiment of a computer system (700).

Computer system (700) may include certain human interface input devices. Such a human interface input device may be responsive to input by one or more human users through, for example, tactile input (such as: keystrokes, swipes, data glove movements), audio input (such as: voice, clapping), visual input (such as: gestures), olfactory input (not depicted). The human interface devices can also be used to capture certain media not necessarily directly related to conscious input by a human, such as audio (such as: speech, music, ambient sound), images (such as: scanned images, photographic images obtain from a still image camera), video (such as two-dimensional video, three-dimensional video including stereoscopic video).

Input human interface devices may include one or more of (only one of each depicted): keyboard (701), mouse (702), trackpad (703), touch screen (710), data-glove (not shown), joystick (705), microphone (706), scanner (707), and camera (708).

Computer system (700) may also include certain human interface output devices. Such human interface output devices may be stimulating the senses of one or more human users through, for example, tactile output, sound, light, and smell/taste. Such human interface output devices may include tactile output devices (for example tactile feedback by the touch-screen (710), data-glove (not shown), or joystick (705), but there can also be tactile feedback devices that do not serve as input devices), audio output devices (such as: speakers (709), headphones (not depicted)), visual output devices (such as screens (710) to include CRT screens, LCD screens, plasma screens, OLED screens, each with or without touch-screen input capability, each with or without tactile feedback capability—some of which may be capable to output two dimensional visual output or more than three dimensional output through means such as stereographic output; virtual-reality glasses (not depicted), holographic displays and smoke tanks (not depicted)), and printers (not depicted). These visual output devices (such as screens (710)) can be connected to a system bus (748) through a graphics adapter (750).

Computer system (700) can also include human accessible storage devices and their associated media such as optical media including CD/DVD ROM/RW (720) with CD/DVD or the like media (721), thumb-drive (722), removable hard drive or solid state drive (723), legacy magnetic media such as tape and floppy disc (not depicted), specialized ROM/ASIC/PLD based devices such as security dongles (not depicted), and the like.

Those skilled in the art should also understand that term "computer readable media" as used in connection with the presently disclosed subject matter does not encompass transmission media, carrier waves, or other transitory signals.

Computer system (700) can also include a network interface (754) to one or more communication networks (755). The one or more communication networks (755) can for example be wireless, wireline, optical. The one or more communication networks (755) can further be local, wide-area, metropolitan, vehicular and industrial, real-time, delay-tolerant, and so on. Examples of the one or more communication networks (755) include local area networks such as Ethernet, wireless LANs, cellular networks to include GSM, 3G, 4G, 5G, LTE and the like, TV wireline or wireless wide area digital networks to include cable TV, satellite TV, and terrestrial broadcast TV, vehicular and industrial to include CANBus, and so forth. Certain networks commonly require external network interface adapters that attached to certain general purpose data ports or peripheral buses (749) (such as, for example USB ports of the computer system (700)); others are commonly integrated into the core of the computer system (700) by attachment to a system bus as described below (for example Ethernet interface into a PC computer system or cellular network interface into a smartphone computer system). Using any of these networks, computer system (700) can communicate with other entities. Such communication can be uni-directional, receive only (for example, broadcast TV), uni-directional send-only (for example CANbus to certain CANbus devices), or bi-directional, for example to other computer systems using local or wide area digital networks. Certain protocols and protocol stacks can be used on each of those networks and network interfaces as described above.

Aforementioned human interface devices, human-accessible storage devices, and network interfaces can be attached to a core (740) of the computer system (700).

The core (740) can include one or more Central Processing Units (CPU) (741), Graphics Processing Units (GPU) (742), specialized programmable processing units in the form of Field Programmable Gate Areas (FPGA) (743), hardware accelerators for certain tasks (744), graphics adapters (750), and so forth. These devices, along with Read-only memory (ROM) (745), Random-access memory (746), internal mass storage (747) such as internal non-user accessible hard drives, SSDs, and the like, may be connected through the system bus (748). In some computer systems, the system bus (748) can be accessible in the form of one or more physical plugs to enable extensions by additional CPUs, GPU, and the like. The peripheral devices can be attached either directly to the core's system bus (748), or through a peripheral bus (749). In an example, the screen (710) can be connected to the graphics adapter (750). Architectures for a peripheral bus include PCI, USB, and the like.

CPUs (741), GPUs (742), FPGAs (743), and accelerators (744) can execute certain instructions that, in combination, can make up the aforementioned computer code. That computer code can be stored in ROM (745) or RAM (746). Transitional data can also be stored in RAM (746), whereas permanent data can be stored for example, in the internal mass storage (747). Fast storage and retrieve to any of the memory devices can be enabled through the use of cache memory, that can be closely associated with one or more CPU (741), GPU (742), mass storage (747), ROM (745), RAM (746), and the like.

The computer readable media can have computer code thereon for performing various computer-implemented operations. The media and computer code can be those specially designed and constructed for the purposes of the present disclosure, or they can be of the kind well known and available to those having skill in the computer software arts.

As an example and not by way of limitation, the computer system having architecture (700) and specifically the core (740) can provide functionality as a result of processor(s) (including CPUs, GPUs, FPGA, accelerators, and the like) executing software embodied in one or more tangible, computer-readable media. Such computer-readable media can be media associated with user-accessible mass storage as introduced above, as well as certain storage of the core (740) that are of non-transitory nature, such as core-internal mass storage (747) or ROM (745). The software implementing various embodiments of the present disclosure can be stored in such devices and executed by core (740). A computer-readable medium can include one or more memory devices or chips, according to particular needs. The software can cause the core (740) and specifically the processors therein (including CPU, GPU, FPGA, and the like) to execute particular processes or particular parts of particular processes described herein, including defining data structures stored in RAM (746) and modifying such data structures according to the processes defined by the software. In addition or as an alternative, the computer system can provide functionality as a result of logic hardwired or otherwise embodied in a circuit (for example: accelerator (744)), which can operate in place of or together with software to execute particular processes or particular parts of particular processes described herein. Reference to software can encompass logic, and vice versa, where appropriate. Reference to a computer-readable media can encompass a circuit (such as an integrated circuit (IC)) storing software for execution, a circuit embodying logic for execution, or both, where appropriate. The present disclosure encompasses any suitable combination of hardware and software.

While this disclosure has described several exemplary embodiments, there are alterations, permutations, and various substitute equivalents, which fall within the scope of the disclosure. It will thus be appreciated that those skilled in the art will be able to devise numerous systems and methods which, although not explicitly shown or described herein, embody the principles of the disclosure and are thus within the spirit and scope thereof

What is claimed is:

1. A method for decoding audio data of an audio scene, the method comprising:

receiving first audio source data of a first audio source and second audio source data of a second audio source, the first audio source being included in a space of interest in the audio scene and encoded according to a first encoding scheme, the second audio source being outside the space of interest in the audio scene and encoded according to a second encoding scheme, the space of interest in the audio scene being represented by at least one of a listener space, an audio channel, or an audio object, and the second encoding scheme being different from the first encoding scheme;

decoding the first audio source data according to a first decoding scheme based on the first audio source being included in the space of interest; and decoding the second audio source data according to a second decoding scheme based on the second audio source being outside the space of interest, the second decoding scheme being different from the first decoding scheme.

2. The method of claim 1, wherein the decoding the second audio source data comprises:

determining that the second audio source data is not to be decoded based on the second audio source being determined as outside the space of interest.

3. The method of claim 1, wherein the first audio source is a non-stationary audio object.

4. The method of claim 1, wherein the first encoding scheme is configured to encode audio source data of an audio source that is included in the space of interest and the second encoding scheme is configured to not encode audio source data of an audio source that is outside the space of interest.

5. The method of claim 1, wherein the first encoding scheme includes a first bit allocation used in encoding audio source data of an audio source that is included in the space of interest and the second encoding scheme includes a second bit allocation used in encoding audio source data of an audio source that is outside the space of interest, the first bit allocation being greater than the second bit allocation.

6. The method of claim 1, further comprising:

rendering audio content of the first audio source data based on a first audio rendering scheme; and rendering audio content of the second audio source data based on a second audio rendering scheme that is different from the first audio rendering scheme.

7. The method of claim 1, further comprising:

determining that audio content of the first audio source data is to be rendered and audio content of the second audio source data is not to be rendered based on the second audio source being determined as outside the space of interest.

8. The method of claim 3, wherein complexities of the first decoding scheme and the second decoding scheme are different.

9. A method of encoding audio data of an audio scene, the method comprising:

receiving audio content of a plurality of audio sources in the audio scene;

determining, for each of the plurality of audio sources, whether the respective audio source is in a space of interest in the audio scene, the space of interest in the audio scene being represented by at least one of a listener space, an audio channel, or an audio object;

determining that the audio content of the respective audio source is to be encoded according to a first encoding scheme based on the respective audio source being in the space of interest in the audio scene; and determining that the audio content of the respective audio source is to be encoded according to a second encoding scheme based on the respective audio source being outside the space of interest in the audio scene, the second encoding scheme being different from the first encoding scheme, wherein each of the encoded audio content of the plurality of audio sources is decoded according to a first decoding scheme based on the respective audio source being included in the space of interest and according to a second decoding scheme based on the respective audio source being outside the space of interest.

10. The method of claim 9, wherein the plurality of audio sources includes a non-stationary audio object.

11. The method of claim 9, wherein the first encoding scheme is configured to encode audio source data of an audio source that is included in the space of interest and the second encoding scheme is configured to not encode audio source data of an audio source that is outside the space of interest.

12. The method of claim 9, wherein the first encoding scheme includes a first bit allocation and the second encoding scheme includes a second bit allocation that is different from the first bit allocation, the first bit allocation being greater than the second bit allocation.

13. An apparatus for representing a space of interest of an audio scene, the apparatus comprising:

processing circuitry configured to:

receive first audio source data of a first audio source and second audio source data of a second audio source, the first audio source being included in a space of interest in the audio scene and encoded according to a first encoding scheme, the second audio source being outside the space of interest in the audio scene and encoded according to a second encoding scheme, the space of interest in the audio scene being represented by at least one of a listener space, an audio channel, or an audio object, and the second encoding scheme being different from the first encoding scheme;

decode the first audio source data according to a first decoding scheme based on the first audio source being included in the space of interest; and decode the second audio source data according to a second decoding scheme based on the second audio source being outside the space of interest, the second decoding scheme being different from the first decoding scheme.

14. The apparatus of claim 13, wherein the processing circuitry is configured to:

determine that the second audio source data is not to be decoded based on the second audio source being determined as outside the space of interest.

15. The apparatus of claim 13, wherein the first audio source is a non-stationary audio object.

16. The apparatus of claim 13, wherein the first encoding scheme is configured to encode audio source data of an audio source that is included in the space of interest and the second encoding scheme is configured to not encode audio source data of an audio source that is outside the space of interest.

17. The apparatus of claim 13, wherein the first encoding scheme includes a first bit allocation used in encoding audio source data included in the space of interest and the second encoding scheme includes a second bit allocation used in encoding audio source data that is outside the space of interest, the first bit allocation being greater than the second bit allocation.

18. The apparatus of claim 13, wherein the processing circuitry is configured to:

render audio content of the first audio source data based on a first audio rendering scheme; and render audio content of the second audio source data based on a second audio rendering scheme that is different from the first audio rendering scheme.

19. The apparatus of claim 13, wherein the processing circuitry is configured to:

determine that audio content of the first audio source data is to be rendered and audio content of the second audio source data is not to be rendered based on the second audio source being determined as outside the space of interest.

20. The apparatus of claim 15, wherein complexities of the first decoding scheme and the second decoding scheme are different.

* * * * *